US010920547B2

(12) United States Patent
Hansen

(10) Patent No.: US 10,920,547 B2
(45) Date of Patent: Feb. 16, 2021

(54) SYSTEMS AND METHODS FOR KILLING WELLS EQUIPPED WITH JET PUMPS

(71) Applicant: HANSEN DOWNHOLE PUMP SOLUTIONS A.S., Bryne (NO)

(72) Inventor: Henning Hansen, Bryne (NO)

(73) Assignee: HANSEN DOWNHOLE PUMP SOLUTIONS A.S., Bryne (NO)

( * ) Notice: Subject to any disclaimer, the term of this patent is extended or adjusted under 35 U.S.C. 154(b) by 0 days.

(21) Appl. No.: 16/598,931

(22) Filed: Oct. 10, 2019

(65) Prior Publication Data

US 2020/0115999 A1 Apr. 16, 2020

Related U.S. Application Data

(63) Continuation of application No. PCT/IB2018/050938, filed on Feb. 15, 2018.

(60) Provisional application No. 62/489,712, filed on Apr. 25, 2017.

(51) Int. Cl.

| | |
|---|---|
| ***E21B 43/12*** | (2006.01) |
| ***E21B 34/10*** | (2006.01) |
| ***F04F 5/12*** | (2006.01) |

(52) U.S. Cl.

CPC ..... *E21B 43/124* (2013.01); *E21B 34/10* (2013.01); *F04F 5/12* (2013.01)

(58) Field of Classification Search

CPC .... E21B 43/124; E21B 43/122; E21B 43/123; E21B 34/10; E21B 23/00; F04B 47/00; F04B 49/246; F04F 5/12; F04F 5/10; F04F 5/54

See application file for complete search history.

(56) References Cited

U.S. PATENT DOCUMENTS

| | | | | |
|---|---|---|---|---|
| 5,000,264 | A | 3/1991 | Snider | |
| 6,026,904 | A | 2/2000 | Burd et al. | |
| 8,047,285 | B1 | 11/2011 | Smith | |
| 2009/0194293 | A1* | 8/2009 | Stephenson | E21B 33/12 166/372 |
| 2015/0369229 | A1 | 12/2015 | Xiao | |
| 2019/0048695 | A1* | 2/2019 | Hansen | E21B 43/121 |
| 2019/0292889 | A1* | 9/2019 | Hansen | F04D 13/10 |

OTHER PUBLICATIONS

International Search Report, International Application No. PCT/IB2018/050398, dated Jun. 5, 2018.

Written Opinion of the International Search Authority, International Application No. PCT/IB2018/050398, dated Jun. 5, 2018.

* cited by examiner

*Primary Examiner* — Michael R Wills, III

(74) *Attorney, Agent, or Firm* — Richard A. Fagin

(57) ABSTRACT

A wellbore pumping system (10) has at least one jet pump (18, 20) disposed in a tubular string (12) inserted into a subsurface wellbore (II). An intake of the jet pump is in fluid communication with a subsurface reservoir. A discharge of the jet pump is in fluid communication with an interior of a tubular string extending to the surface. A fluid bypass (24, 26) fluidly connects the inlet and discharge of the jet pump. The fluid bypass in some embodiments is operable to enable fluid flow when a differential pressure of fluid pumped into the tubular string from the surface exceeds a predetermined pressure. Another aspect includes a pump system having two separately operable jet pumps in tandem in a wellbore tubular string.

25 Claims, 2 Drawing Sheets

SYSTEMS AND METHODS FOR KILLING WELLS EQUIPPED WITH JET PUMPS

CROSS REFERENCE TO RELATED APPLICATIONS

Continuation of International Application No. PCT/IB2018/050938 filed on Feb. 15, 2018. Priority is claimed from U.S. Provisional Application No. 62/489,712 filed on Apr. 25, 2017. Both the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of related to testing or producing subsea wells, using jet pumps.

Some marine (offshore) subsurface oil-bearing reservoirs have insufficient pressure to lift oil contained therein to surface, that is, to flow naturally. Such reservoirs therefore require some form of artificial lift, for example pumps, gas lift and fluid injection) to move the oil to surface. Shallow reservoirs in the Barents Sea, offshore Norway, for example are known to have such insufficient pressure, and as well have a gas "bubble point", that is, the pressure at which gas exsolves from the oil very close to the natural reservoir pressure.

As a result, in addition to requiring artificial lift to be tested and/or produced efficiently and economically, such reservoirs require using artificial list methods and apparatus that are able to move oil to surface notwithstanding gas exsolution. Artificial lift apparatus such as positive displacement pumps such as electrical submersible pumps (ESPs) may not operate correctly or may be damaged in the presence of substantial amounts of gas in the pumped fluid stream.

Other types of well pumps, for example, jet pumps (also known as eductors, injectors or ejectors) may be limited as to their suitability for reservoir testing is that they are capable of lifting only very limited amounts of fluid, and they have a drawback in the event a well must have its flow stopped ("killed") by pumping fluids into the reservoir from the surface.

DETAILED DESCRIPTION

Figure 1:
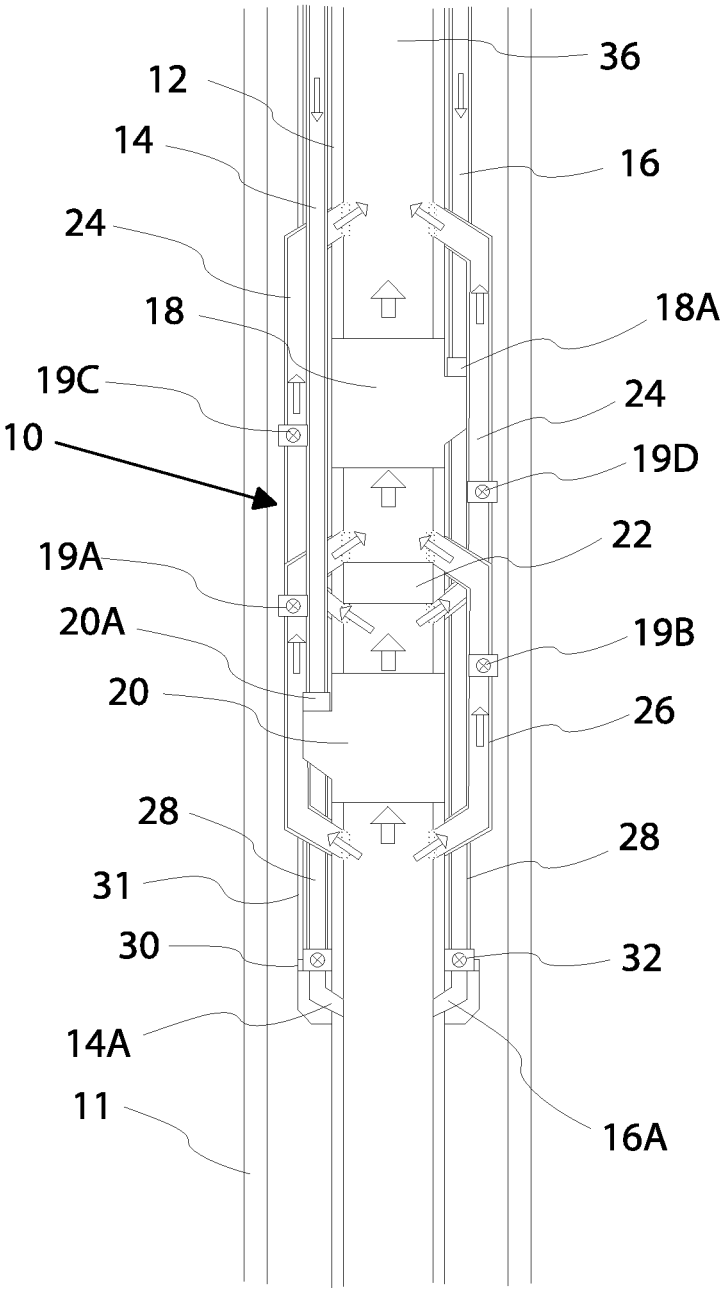
FIG. 1 illustrates two jet pumps mounted on a tubular string in a wellbore.

FIG. 1 illustrates an example embodiment of a wellbore fluid jet pump system 10 (hereinafter "pump system" for convenience) for pumping subsurface reservoir fluids to the surface. The pump system 10 may be coupled within or to a tubular string 12 that extends from surface to a selected depth in a subsurface wellbore 11 and may comprise at least one, and in the present example embodiment two jet pumps, shown as a first jet pump 20, and a second jet pump 18 both coupled to a tubular string 12 at a respective selected longitudinal position along the tubular string 12. The tubular string 12 may comprise a jointed tubing, coiled tubing or any other type of conduit known in the art for moving devices coupled to such conduit and for moving fluid between the wellbore and the surface. The tubular string 12 in the present example embodiment may be a so called "Drill Stem Test" (DST) string.

The first and second jet pumps 20, 18 may be provided operating power by moving liquid and/or gas ("power fluid") from surface along one or more power fluid lines 14, 16 each fluidly coupled to a respective power fluid inlet 20A, 18A of the first and second jet pumps 20, 18. Power fluid may be returned to surface with the subsurface reservoir fluids pumped to the surface, as shown at 36 in FIG. 1, along the interior of the tubular string 12.

The power fluid lines 14, 16 in some embodiments may extend beyond the respective power fluid inlet 20A, 18A of the first 20 and second 18 jet pump, and may be selectively fluidly coupled respectively to one or more pumped fluid inlet lines 14A, 16A to the interior of the tubular string 12 at a longitudinal position below the lowermost jet pump, in the present example embodiment, the first jet pump 20. Selective fluid connection of the power fluid lines 14, 16 to the interior of the tubular string 12 through the power fluid lines 14, 16 may be made through one or more respective control valves 30, 32 that can be selectively opened and closed from the surface, for example, using respective one or more hydraulic, pneumatic or electrical valve control lines 31. In some embodiments, the control valves 30, 32 may be in the form of one or more autonomous check valves set at an opening pressure higher than maximum pressure expected in order to operate the jet pumps 18, 20. Such check valves enable flow from surface through the valve control line(s) 31 into the interior of the tubular string 12, but not from within the tubular string 12 into the power fluid lines 14, 16. When fluids need to be pumped into the tubular string 12 to a position below the pump system 10 from the surface, for example to "bullhead" high density fluids into the tubular string 12 (and possibly into the subsurface hydrocarbon bearing reservoir) to "kill" a wellbore for example, in which fluid flow becomes dangerous or uncontrolled of upon completion of a well test, such fluids can be pumped into the tubular string 12 through either or both the power fluid lines 14, 16 and subsequently through the respective control valves 30, 32.

In some embodiments, the first and second jet pumps 18, 20 and a device between the first and second jet pumps 18, 20, for example a flow divider 22 disposed inside the tubular string 12 between the first and second jet pumps 18, 20, may be designed to be released from the longitudinal positions shown in FIG. 1 by "pump-down" release. Pump-down release in the present disclosure means that if fluids were pumped into the tubular string 12 from above, the first and second jet pumps 18, 20 and any devices between the first and second jet pumps 18, 20 is released from respective mounting positions and are moved downwardly, to expose a respective flow bypass around each respective jet pump 18, 20. The flow bypass(es) may be implemented in the form of an increased internal diameter inside the tubular string 12 or as one or more bypass flow tubes located externally to the tubular string 12 as will be further explained with reference to FIGS. 2A, 2B and 2C implemented as a flow bypass device (34 in FIGS. 2A, 2B and 2C).

In some embodiments, it may be desirable to have two differently sized jet pumps 18, 20, or to have jet pumps each having different gas handling features. In such cases, one or more first flow bypass tube(s) such as first 26 and second flow bypass tubes may be used to conduct fluid flow from a location in the tubular string 12 below one jet pump, e.g., the first jet pump 20, (using first flow bypass tube(s) 26) and above flow divider 22 to an intake side of the second jet pump 18 disposed above the discharge of the first jet pump 18 in the tubular string 12 and the flow divider 22. One or more second bypass tube(s) 24 may be used in some embodiments to conduct fluid discharge from such one jet pump, e.g., the first jet pump 20, into to the tubular string 12 at a position above the other jet pump, e.g., the second jet pump 18 as shown in FIG. 1. In embodiments such as shown in FIG. 1, the flow divider 22 may provide fluid isolation between the discharge side of one bypass tube, e.g., the first bypass tube(s) 24 (fluidly connected to the inlet side of the second jet pump 18) and the intake side of the bypass tube (s), e.g., the first bypass tube(s) 26 (fluidly connected to the discharge side of the first jet pump 18) to enable the first and second jet pumps 20, 18 to pump fluid to surface independently of each other.

In some embodiments, the respective first and second bypass tubes 26, 24 may each comprise respective control valves 19B, 19A and 19D, 19C, respectively to control bypass flow through each of the bypass tubes, respectively. In some embodiments, the control valves 19A through 19D may comprise pneumatic, hydraulic or electrically operated valves. In some embodiments, the control valves 19A, 19B, 19C, 19D may each comprise a pressure relief valve open to flow only when a predetermined pressure differential across the control valve is exceeded. For example, consider the embodiment shown in FIG. 1 in which the second jet pump 18 is omitted, as well as its respective power fluid line 16, control valve 16A, control valve 14A, second bypass line 24 and the flow divider 22. Thus for purposes of the scope of the present embodiment, the functional components of the pump system 10 may comprise the first jet pump 20, the second bypass tube 26, power fluid line 14, and control valve 19A. In such embodiments, during ordinary operation of the first jet pump 20, power fluid is delivered to the first jet pump 18 along power fluid line 14 such that fluid is moved upwardly into the tubular string 12 into the inlet of the first jet pump 18. Fluid discharged from the first jet pump 18 is directed to the interior of the tubular string 12 for movement to the surface. Fluid is prevented from moving through the second bypass line 26 by the action of the control valve 19A as long as the pressure differential induced by the first jet pump 20 does not exceed the predetermined pressure differential of the control valve 19A. If it becomes necessary to pump a high density fluid into the tubular string 12 to "kill" fluid flow from the wellbore 11, such fluid may be pumped into the tubular string 12 from the surface, and may bypass the first jet pump 20 by entering the first bypass tube(s) 26, opening the control valve 19A by applying differential pressure above the predetermined pressure, and flowing into the tubular string 12 below the first jet pump 20 so as to "kill" the flow into the wellbore 11.

Thus in a method according to one aspect of the present disclosure, a subsurface wellbore may be operated to lift reservoir fluid to surface by pumping a power fluid into a power fluid inlet of at least one jet pump to lift reservoir fluid to the surface through a tubular string coupled to a discharge of the at least one jet pump, and killing the wellbore by pumping a kill fluid into the tubular string from the surface until a differential pressure in the kill fluid exceeds a predetermined pressure so as to open a fluid flow bypass across the inlet and discharge of the at least one jet pump. In the above described embodiment, the fluid flow bypass may comprise a control valve in a bypass line, wherein the bypass line is fluidly connected across the inlet and discharge of the jet pump. The embodiment shown in FIG. 1 may comprise the first 20 and second 18 jet pumps in tandem along the tubular string 12. Fluid bypass may be obtained for both jet pumps 20, 18 using the bypass lines 24, 26, optionally the power fluid lines 14, 16, and the control valves as shown in FIG. 1.

Power fluid to operate the first and second jet pumps 18, 20 may be, for example, seawater, fresh water, and/or produced oil or gas returned to surface and pumped into the power fluid lines 14, 16.

A method for pumping fluid in the tubular string 12 may be used within a seabed to surface drilling or work-over riser (not shown), as well as within the wellbore 11.

Power fluid to operate one or more jet pumps 18, 20 may also be pumped directly into the wellbore 11, if there is a sealing arrangement below the pump system 10 and above any hydraulic between one or several zones below the pump system 10 and the interior of the wellbore. This would remove the need for one or several fluid power lines 14, 16, from the surface, but would still require the bypass tube(s) 24, 26.

Figure 2A:
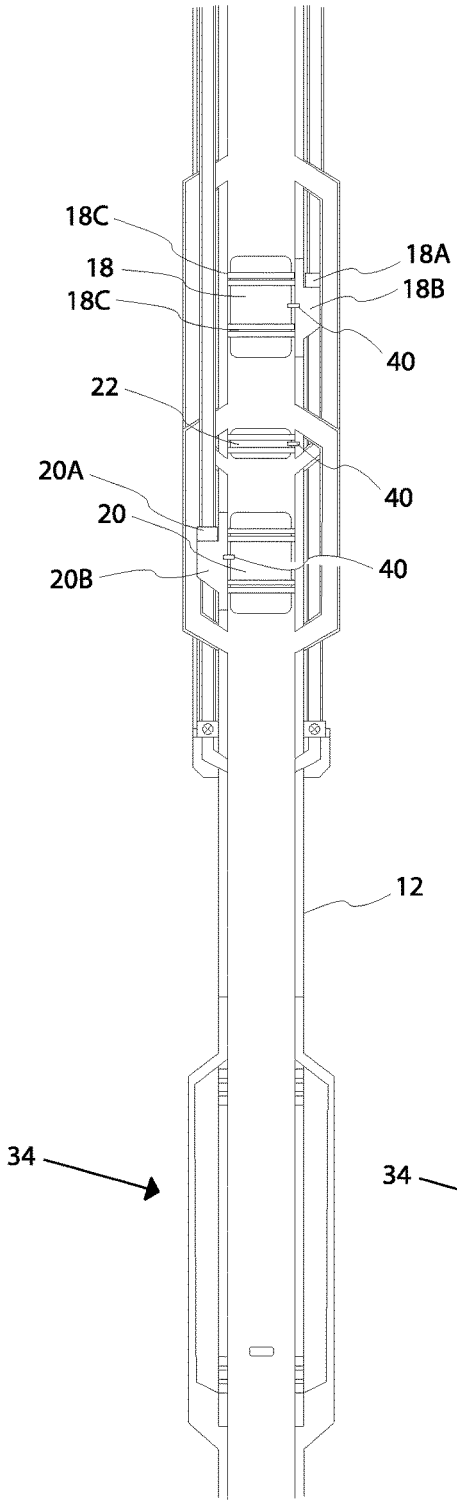
FIGS. 2A, 2B and 2C illustrate jet pumps that can be pumped into a wellbore into a receptacle below to allow pumping kill fluid into wellbore tubulars to a position below the jet pumps.
Figure 2B:
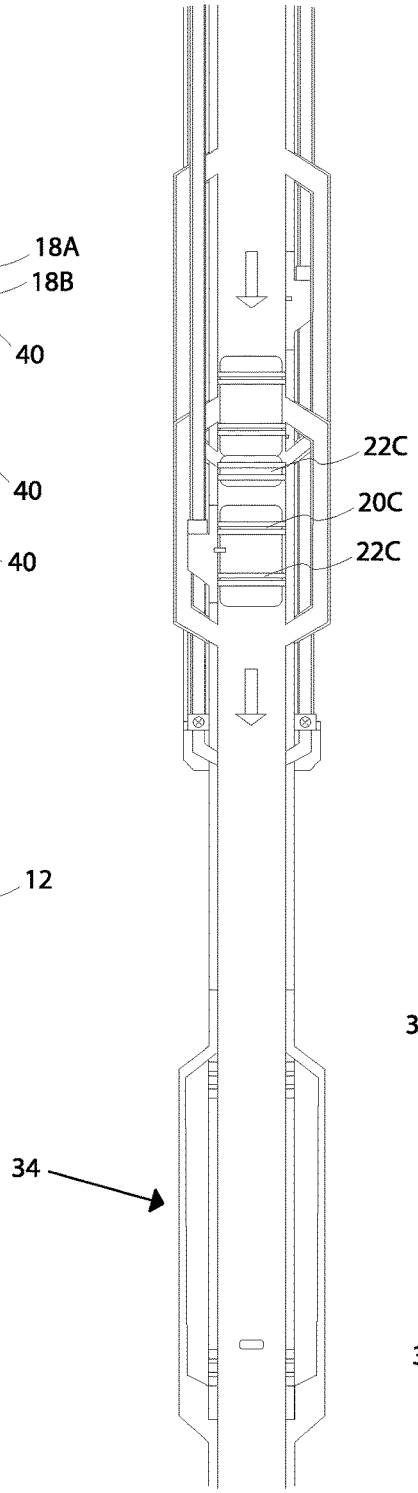
Figure 2C:
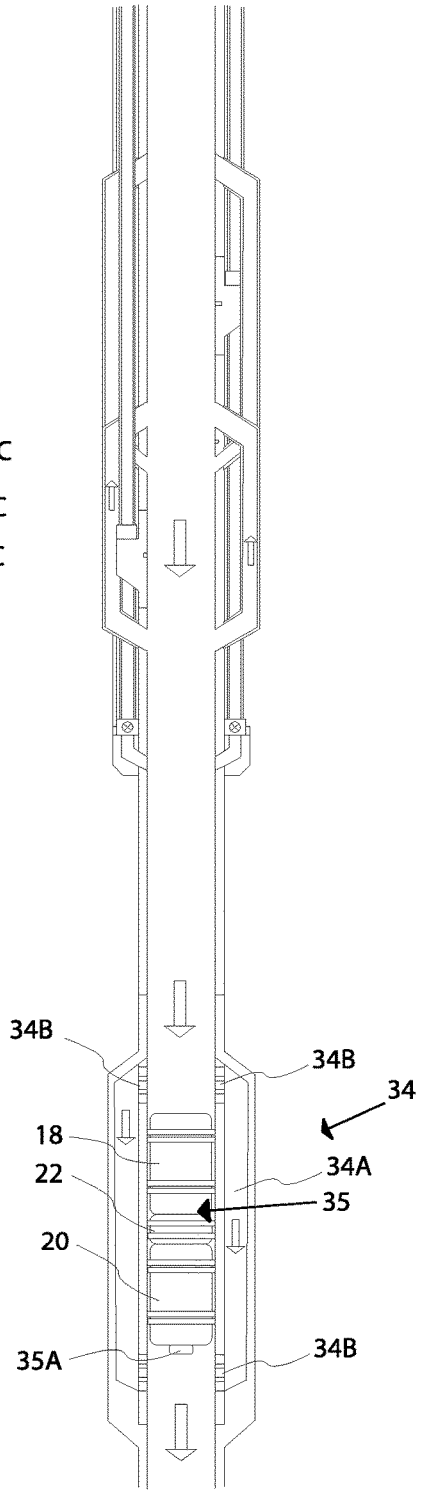

FIGS. 2A, 2B and 2C illustrate another embodiment wherein the jet pumps 20, 18 can be moved axially along the tubular string 12 such as by pumping to move downwardly into a flow bypass device 34 in the tubular string 12. Moving the jet pumps 20, 18 into the flow bypass device 34 enables pumping "kill" fluid into the tubular string below the jet pumps 20, 18 to enable "killing" the reservoir inflow into the wellbore. In FIGS. 2A through 2C, like components are illustrated with the same reference numerals as in FIG. 1. FIG. 2A shows the first 20 and second 18 jet pumps and a flow divider 22 disposed between the jet pumps 20, 18 located in their ordinary operating positions within the tubular string 12. When high density, "kill" fluid is to be pumped into the wellbore 11 from the surface, the jet pumps 20, 18 and the flow divider 22 (which may be implemented as an integrated section of one of the jet pumps 20, 18, as well as all three components being assembled into a single assembly) may be released from their ordinary operating positions by pumping fluid from surface into the tubular string 12 until, for example, differential pressure exceeds a predetermined pressure. Exceeding the predetermined pressure causes release of retaining devices such as shear pins 40 or other releasable device holding the jet pumps 18, 20 and flow divider 22 in place axially in the tubular string 12. Once the shear pins 40 are broken, the jet pumps 20, 18 and the flow divider 22 may move downwardly in the tubular string 12 by reason of the fluid pumped into the tubular string 12 as shown in FIG. 2B. Continued pumping from the surface will move the jet pumps 20, 18 and flow divider 22 down into the tubular string mounted flow bypass device 34. The flow bypass device 34 may have a flow bypass implemented as a concentric flow bypass area 34A and ports 34B between the interior of the tubular string 12 and an interior of the flow bypass area 34A above and below a final resting position 35 of the jet pumps 20, 18 and flow divider 22 in the flow bypass device 34, as illustrated in FIG. 2C. The final resting position 35 may be established using a stop 35A of any type known in the art, including, for example and without limitation a go/no go diameter restriction, an insert stop device or a muleshoe sub. Using the flow bypass device 34 shown in FIGS. 2A, 2B and 2C may enable pumping fluid such as kill fluid into the wellbore (11 in FIG. 1) below the jet pumps 20, 18 without the need to use the power fluid lines 14, 16 and valves 30, 32, or the first and second bypass tubes 26, 24 and control valves 19A through 19D as kill fluid injection lines in the manner explained with reference to FIGS. 1 and 2. In the embodiment shown in FIGS. 2A, 2B and 2C, the respective power fluid inlets 18A, 20A in the ordinary operating position may be provided by coupling a respective power fluid inlet sub 18B, 20B coupled within the tubular string 12. The power fluid inlet subs 18B, 20B may each comprise an interior surface to enable sealing engagement of seals 18C, 20C, 22C such as o-rings disposed on the exterior of the jet pumps 18, 20 and flow divider 22, respectively. The seals 18C, 20C, 22C may also enable longitudinal movement of the jet pumps 18, 20 and flow divider 22 along the interior of the tubular string 12 so that the jet pumps 18, 20 and flow divider 22 can be pumped to the final resting position 35. It will be appreciated by those skilled in the art that the first jet pump 18, the second jet pump 20 and the flow divider 22 may be retrievable from the resting position 35 using any known retrieval device, including without limitation, coiled tubing, spoolable semi-stiff rod, wireline or slickline.

The embodiment shown in FIGS. 2A through 2C may be implemented using only flow divider 22. If only one jet pump is used, a flow divider 22 is not required. Thus in a method according to the present disclosure using the apparatus shown in FIGS. 2A, 2B and 2C, a subsurface wellbore may be operated to lift reservoir fluid to surface by pumping a power fluid into a power fluid inlet of at least one jet pump to lift reservoir fluid to the surface through a tubular string coupled to a discharge of the at least one jet pump. Killing the wellbore may be performed by pumping a kill fluid into the tubular string from the surface until a differential pressure in the kill fluid exceeds a predetermined pressure so as to open a fluid flow bypass across the inlet and discharge of the at least one jet pump. In the present embodiment, the fluid flow bypass may be implemented by releasably locking the at least one jet pump in place in the tubular string, whereby applying the predetermined pressure causes the lock to release. The at least one jet pump may be moved along the tubular string into a device having a flow bypass across the at least one jet pump when the at least one jet pump is in place in the device.

Power fluid to operate one or several jet pumps may also be pumped directly into the wellbore 11 (FIG. 1), if there is a sealing arrangement below the pump system 10 (FIG. 1) and above any hydraulic connection between one or more zones below the pump system 10 (FIG. 1). This would remove the need for one or more power fluid lines 14, 16 (FIG. 1), extending from the surface, but would still require the first and second flow bypass tubes 24 (FIG. 1).

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A wellbore pump system, comprising:

at least one jet pump disposed in a tubular string inserted into a subsurface wellbore, an inlet of the at least one jet pump in fluid communication with a subsurface reservoir, a discharge of the at least one jet pump in fluid communication with an interior of the tubular string; and a first fluid bypass fluidly connecting the inlet and discharge of the at least one jet pump, the fluid bypass operable to enable fluid flow when a differential pressure of fluid pumped into the tubular string from the surface exceeds a predetermined pressure, the first fluid bypass comprising a control valve operable to close fluid flow in a first direction and to open fluid flow in a direction opposed to the first direction when a pressure differential exceeds the predetermined pressure.

2. The system of claim 1 wherein the control valve is disposed in a power fluid line fluidly coupled to an interior of the tubular string below the at least one jet pump.

3. The system of claim 1 further comprising a pump down release retaining the at least one jet pump in axial position within the tubular string, the pump down release configured to release the at least one jet pump when the differential pressure exceeds the predetermined pressure, the system further comprising a second fluid bypass in the tubular string, the second fluid bypass comprising a stop to restrain movement of the at least one jet pump, the second fluid bypass comprising a flow bypass to enable fluid flow in the tubular string from above the at least one jet pump to below the at least one jet pump when the at least one jet pump is disposed against the stop.

4. The system of claim 3 wherein the flow bypass comprises a flow bypass area having ports connected between a position above the at least one jet pump and below the at least one jet pump fluidly coupled to an interior of the tubular string.

5. The system of claim 3 wherein the pump down release comprises a shear pin.

6. A method for operating a subsurface wellbore, comprising:

operating at least one jet pump to lift a first fluid within a tubular string in the wellbore to the surface;

introducing a second fluid from the surface into a subsurface reservoir by pumping the second fluid into the tubular string until a differential pressure across the at least one jet pump exceeds a predetermined pressure, whereby the second fluid bypasses the at least one jet pump; and operating a control valve operable to close fluid flow in one direction and to open fluid flow in a direction opposed to the first direction when the differential pressure exceeds the predetermined pressure.

7. The method of claim 6 wherein the control valve in a power fluid line fluidly coupled to an interior of the tubular string to an interior of the tubular string below the at least one jet pump.

8. The method of claim 7 further comprising applying pressure to an interior of the tubular string to cause the differential pressure to exceed the predetermined pressure, whereby a pump down release is actuated to enable the at least one jet pump to move axially into a flow bypass device in the tubular string to enable fluid flow in the tubular string from above the at least one jet pump to below the at least one jet pump when the at least one jet pump is disposed against a stop in the bypass device.

9. The method of claim 8 wherein predetermined pressure is set by a shear pin.

10. A wellbore pump system, comprising:

a first jet pump and a second jet pump disposed at longitudinally spaced apart locations along a tubular string in a wellbore;

a flow divider disposed in the tubular string between the first jet pump and the second jet pump;

a first flow bypass tube having one end in fluid communication with an interior of the tubular string below an inlet of the first jet pump and a discharge in fluid communication with an inlet of the second jet pump; and a second flow bypass tube having an inlet in fluid communication with a discharge of the first jet pump and a discharge in fluid communication with an interior of the tubular string above the second jet pump.

11. The system of claim 10 further comprising a control valve disposed in each of the first and second flow bypass tubes, each control valve operable to close fluid flow in one direction and to close fluid flow in a direction opposed to the first direction when a pressure differential exceeds a predetermined pressure.

12. The system of claim 10 further comprising respective a power fluid line fluidly connected to a power fluid inlet of each of the first jet pump and the second jet pump.

13. The system of claim 12 further comprising a control valve in each respective power fluid line to selectively open flow in each respective power fluid line to an interior of the tubular string below the first jet pump and the second jet pump.

14. The system of claim 10 further comprising a pump down release retaining the first jet pump, the second jet pump and the flow divider in axial position within the tubular string, the pump down release configured to release the first jet pump, the second jet pump and the flow divider when a differential pressure exceeds a predetermined pressure, the system further comprising a flow bypass device in the tubular string, the flow bypass device comprising a stop to restrain movement of the first jet pump, the second just pump and the flow divider beyond the flow bypass device, the flow bypass device comprising a flow bypass to enable fluid flow in the tubular string from above the second jet pump to below the first jet pump when the second jet pump, the flow divider and the first jet pump are disposed against the stop.

15. The system of claim 14 wherein the pump down release comprises a shear pin.

16. The system of claim 10 wherein the first jet pump is a different size than the second jet pump.

17. The system of claim 10 wherein the first jet pump has different gas handling features than the second jet pump.

18. A method for operating a subsurface wellbore, comprising:

supplying power fluid to a first jet pump and a second jet pump disposed above the first jet pump and at longitudinally spaced apart locations along a tubular string in a wellbore;

first bypassing fluid flow below an inlet of the first jet pump to an inlet of the second jet pump;

second bypassing fluid flow from a discharge of the first jet pump to an interior of the tubular string above a discharge of the second jet pump; and separating fluid flow between the discharge of the first jet pump and the inlet of the second jet pump to enable the first and second bypassing.

19. The method of claim 18 further comprising operating a control valve disposed in each of a first and a second flow bypass tube, each control valve operable to pump fluid from above the second jet pump into the interior of the tubular string below the first jet pump.

20. The method of claim 19 wherein each control valve is configured to close fluid flow in one direction and to close fluid flow in a direction opposed to the first direction when a pressure differential exceeds a predetermined pressure.

21. The method of claim 18 further comprising operating a control valve to divert power fluid from a respective power fluid inlet of each jet pump to the interior of the tubular string.

22. The method of claim 18 further comprising:

actuating a pump down release retaining the first jet pump, the second jet pump and a flow divider in axial position within the tubular string, the pump down release configured to release the first jet pump, the second jet pump and the flow divider by pumping fluid from surface into the tubular string until a differential pressure exceeds a predetermined pressure; continuing pumping fluid from the surface to move the first jet pump, the second jet pump and the flow divider into a flow bypass device in the tubular string; and continuing pumping the fluid from the surface through the bypass device into the tubular string below the first jet pump.

23. The method of claim 22 wherein the pump down release comprises a shear pin.

24. The method of claim 18 wherein the first jet pump is a different size than the second jet pump.

25. The method of claim 18 wherein the first jet pump has different gas handling features than the second jet pump.

* * * * *